US008149097B2

(12) United States Patent
Solow

(10) Patent No.: US 8,149,097 B2
(45) **Date of Patent: *Apr. 3, 2012**

(54) HORN DEVICE HAVING A POWER SUPPLY AND AN ELECTRICAL CONTROL CIRCUIT

(75) Inventor: Stanley Solow, Plainview, NY (US)

(73) Assignee: Wolo Mfg. Corp., Deer Park, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/178,874

(22) Filed: Jul. 8, 2011

(65) Prior Publication Data

US 2011/0268306 A1 Nov. 3, 2011

(51) Int. Cl.
*G08B 21/00* (2006.01)

(52) U.S. Cl. ..... 340/388.1; 181/152; 340/693.2

(58) Field of Classification Search ..... 340/388.1, 340/693.2; 181/152, 159; 381/396
See application file for complete search history.

(56) References Cited

U.S. PATENT DOCUMENTS

| | | | |
|---|---|---|---|
| 2,314,108 | A | 3/1943 | Silverman |
| 2,428,147 | A | 9/1947 | Dalrymple |
| 2,692,913 | A | 10/1954 | Kamimori |
| 2,808,458 | A | 10/1957 | Raphael et al. |
| 2,830,116 | A | 4/1958 | Hardesty |
| 2,915,587 | A | 12/1959 | Hardesty |
| 4,114,973 | A | 9/1978 | Stiller |
| D271,968 | S | 12/1983 | Segan et al. |
| 5,047,961 | A | 9/1991 | Simonsen |
| 5,259,807 | A | 11/1993 | Crow |
| 5,315,533 | A | 5/1994 | Stich et al. |
| 5,392,528 | A | 2/1995 | McDougall |
| 5,859,915 | A | 1/1999 | Norris |
| 5,956,863 | A | 9/1999 | Allen |
| 6,191,696 | B1 | 2/2001 | Young et al. |
| 6,587,400 | B1 | 7/2003 | Line |
| 6,739,071 | B2 | 5/2004 | Andis et al. |
| 6,893,140 | B2 | 5/2005 | Storey et al. |
| D568,195 | S | 5/2008 | Solow |
| 2001/0015893 | A1 | 8/2001 | Campman |
| 2002/0147035 | A1 | 10/2002 | Su |
| 2003/0177657 | A1 | 9/2003 | Andis et al. |
| 2004/0243263 | A1 | 12/2004 | Gardner et al. |
| 2005/0072019 | A1 | 4/2005 | Rago et al. |
| 2005/0078470 | A1 | 4/2005 | Yang |
| 2005/0184137 | A1 | 8/2005 | Dorsey et al. |
| 2005/0231333 | A1 | 10/2005 | Woods |
| 2008/0036595 | A1 | 2/2008 | Hollstien et al. |
| 2008/0084282 | A1 | 4/2008 | Solow |
| 2008/0258883 | A1 | 10/2008 | Solow |
| 2009/0070967 | A1 | 3/2009 | Gonzalez |

*Primary Examiner* — Jeffery Hofsass

(74) *Attorney, Agent, or Firm* — Andrew F. Young, Esq.; Lackenbach Siegel, LLP

(57) ABSTRACT

An electro-mechanical horn is configured with a body, a sound-generating unit mounted in the body, and a plurality of power source receiving regions for storing at least one removably mounted power source in a storage manner while containing a second power source in an operative manner thereby limiting discontinuity of the operation of the sound-generating unit.

5 Claims, 4 Drawing Sheets

44

HORN DEVICE HAVING A POWER SUPPLY AND AN ELECTRICAL CONTROL CIRCUIT

CROSS REFERENCE TO RELATED APPLICATIONS

This application claims priority from US Design Pat. No. D568,195 filed Nov. 6, 2006, U.S. Ser. No. 11/678,818 filed Feb. 26, 2007, now allowed, the entire contents of which are incorporated herein by reference.

BACKGROUND OF THE INVENTION

I. Field of the Invention

This invention relates to hand held signaling device used to signals over wide distances. More particular, the invention relates to a portable electrical horn having an improved safety, portability, reliability, and an increased power source storage capacity.

II. Related Prior Art

Horns are widely used, among others, in sporting, hunting, and rescue operations. Typically, horns are divided in two distinct types: air horn and electrical sirens.

Hand-held air horn devices operate with use of a compressed gas released from a high-pressure canister (the gases) may be compressed air, butane, Hydro Fluoro Carbon (HFC) 134 A gas (Environmentally Safe Freon), Freon® 22 as an HCFC refrigerant, and any other type of compressed gas combinations (Nitrogen, Argon, etc.) (collectively each of these conventional gasses and gas compositions/mixtures are referred to as either "gas" or "air" as discussed hereafter).

Air horns of this type normally have an acoustically required trumpet-type fixture which operates in concert with an actuator button and a cone-shaped trumpet nozzle which is configured to produce a loud horn blast when air is released from the canister and through the trumpet fixture and outwardly from the conical trumpet nozzle.

Hand-held air horns have typically a limited capacity since the dimensions of the canister are critical to the horn's portability. A configuration of an air horn device is rather complicated due to numerous mechanical components including, among others, the above-mentioned canister, trumpet nozzle and the required and associated seals, but have been historically used for generation of a loud annunciation of some signal.

Specifically, conventional air horn devices should be configured to have excellent sealing characteristics so as to prevent compressed fluid from leaking though the housing of the device, risking functional loss, poisoning, staining, and other detriments noted below. Additionally, the accidental loss of gas pressure renders an air horn non-functional, and the slow loss of pressure (via a slow leak), results in a steadily decreasing audio output.

However, due to the limitations of sealing technology, many known air horn devices may not be satisfactory leak-proof. As a consequence, the condensate formed during the use of an air horn device (from the endothermic transformation from high to low pressure and from a liquid to a gas) may leak through poorly sealed joints and burn the hands of the user where such condensate is super-cold or an irritant to the skin.

Still a further negative consequence of the poorly sealed air horn device relates to the user's hands which may become slippery during the use of the device which, in turn, may negatively affect a grip on the device by the user. Furthermore, used at high altitudes, an air horn device may be health-hazardous due to the expansion of compressed fluid/propellant, which may minimize the effectiveness of the device and, in extreme situations, lead to fire for select gas compositions. Structural countermeasures directed to minimization of the above-discussed problems often lead to an overly complicated structure of the device that may be cost-prohibitive.

Finally, an additional detriment to many conventional gasses involves the problem of unintentional poisoning or accidental oxygen substitution. For example, a case of accidental Freon 22 (monochlorodifluoromethane) poisoning in a fishing vessel has been reported (See report by Koreeda A., Department of Forensic Medicine, Graduate School of Medical Sciences, Kumamoto University, 1-1-1 Honjo, Kumamoto 860-8556, Japan, Forensic Sci. Int. 2006 Feb. 18.

Electric horns alleviate at least some of the problems associated with the air-type horn device. Typically, electrical horns have traditionally used a vibrating diaphragm driven by an electromagnetic device. Current pulses are developed by a mechanical switch responsive to diaphragm movement such that the switch, being normally closed, would energize a magnetic coil to cause diaphragm movement in one direction against its spring bias. The movement of the diaphragm would also open the switch allowing the diaphragm to return in the other direction thus closing the switch and causing the cycle to repeat. The life of such horns is limited by the life of a power source used in the horn, which, unfortunately, may not be satisfactory. Similarly, the decibel (dB) range for common electrical horns is limited to an initial response of about 90 dB based on the low current level available from conventional battery systems.

A need, therefore, exists for a portable electrical horn that has an increased power-source storage capacity, that has a simple structure allowing for a convenient storage and easy replacement of power sources, that has an extend useful shelf life without the detriments caused by leaks, and that is safely handled by all users including children and the unskilled without danger.

Still a further need exists for a portable electric horn providing for unmistakable indication of the end of the useful life of the current power source and automatic switching between the current power source and a spare one.

SUMMARY OF THE INVENTION

These and other needs are met by a portable electric horn configured in accordance with the present disclosure. The disclosed electrical horn has a housing provided with two spaced apart compartments configured to receive respective main and spare power sources. Preferably, but not necessarily, a power source includes a nickel cadmium (NiCad) battery or other form of extended-life or added current-strength battery. The presence of the spare power source increases the useful life of the disclosed horn allowing the user to easily replace the main exhausted source with a new one in a time-effective and simple manner without the risk of draining the stored power-source caused by constant electrical connection.

The housing of the disclosed horn preferably has a pistol-shaped configuration including an elongated handle and a casing extending transversely to the longitudinal axis of the elongated handle. The housing is preferably molded and has one of the battery storing compartments in the handle and the other compartment in the casing. The housing, thus, encloses, protects and provides mounting for the electronic, mechanical and electro-mechanical components of the disclosed horn in a secure manner safe from damage during transportation and extended-period storage (in emergency storage for example).

Each of the battery receiving compartments is located so as to provide the user with an easy access. Preferably, the compartment provided in the handle of the housing opens into the bottom of the handle, whereas the other compartment is located next to the proximate end of the casing. Both compartments are closed by respective shutters detachably mounted to the housing and easily operated by the user yet sufficient to provide moisture resistance during long-term storage or rigorous use.

The compartments are not uniformly configured, but each is shaped and dimensioned to allow a battery to be properly guided to a storage/operating position. The shutters may be provided with respective locking or latch mechanisms reliably securing the batteries within the respective compartments, but allowing the user to easily open the shutters so as to insert or remove the batteries in/from the compartments.

While alternative operational circuits may be provided without departing from the scope and spirit of the present invention, an optional design provides the disclosed horn with an electronic driver supplying short current pulses to an electric sound-producing device. The driver is configured with an oscillator used to provide a series of pulses to an electromagnet which attracts a ferromagnetic diaphragm. The pulses have a repetition rate substantially less than the natural frequency (3000 Hz) of the diaphragm. For each pulse, the electromagnet attracts and then releases the diaphragm to allow it to vibrate through a number of cycles before applying another pulse. It is further proposed that a feedback circuit responsive to diaphragm position slaves the pulse timing to the diaphragm frequency to assure efficient coupling. This arrangement is preferably adapted to high frequency horns (100 dB or more) which have relatively small diaphragm movement and readily continue to vibrate when input pulses are removed, but is not restricted to any particular type of dB range or frequency.

To efficiently operate a horn, it is suggested to couple the electrical energy into the mechanical part of the system in a manner which makes best use of that energy already imparted to the diaphragm assembly. The synchronism of input pulses and diaphragm movement is of useful importance in obtaining the highest sound energy output for a given electrical power input. In accordance with this alternative aspect of the disclosure, the disclosed horn has a central processing unit (CPU) executing software which is operative to provide the desired synchronism, although it will be recognized that aspects of the present invention may be operated by various alternative electronic operational modes and circuitry without departing from the scope and spirit of the present invention.

In a further aspect of the disclosure, a software executable by the CPU is operative to monitor the operation of a currently working battery and activate a spare battery when the resources of the currently working battery have been exhausted or are to be exhausted (under normal use or at elevated or reduced temperatures) in the near future at a determinable use-degradation point.

It will be alternatively recognized that the present invention may also be provided with a simplified electrical circuit, without a central processing unit (CPU), such that simple actuation of a trigger completes an electrical circuit between a battery power source and the sound-generating speaker. It is envisioned that while either embodiment is suitable under particular manufacture or user-conditions, that a particular construction will be preferable under a select condition. For example, where low cost is critical, no CPU is included, or alternatively, where delicate power and sound management is critical, a controlling CPU may be optionally included; all without departing from the scope and spirit of the present invention.

In accordance with a further aspect of the disclosure, a means for conveniently suspending the horn to the user includes a strap having one end attached to the user's attire. The other end of the strap is detachably coupled to the housing of the horn so as to allow the user to unfasten the horn when the user's position requires such an action. In alternative variations it shall be recognized that the strap noted above may be a lanyard, rope, belt clip, or shoulder-strap attachment variation without departing from the scope and spirit of the present invention.

BRIEF DESCRIPTION OF THE DRAWINGS

The above and other features and advantages of the inventive assembly will be disclosed in detail in conjunctions with the following, in which.

SPECIFIC DESCRIPTION

Figure 1:
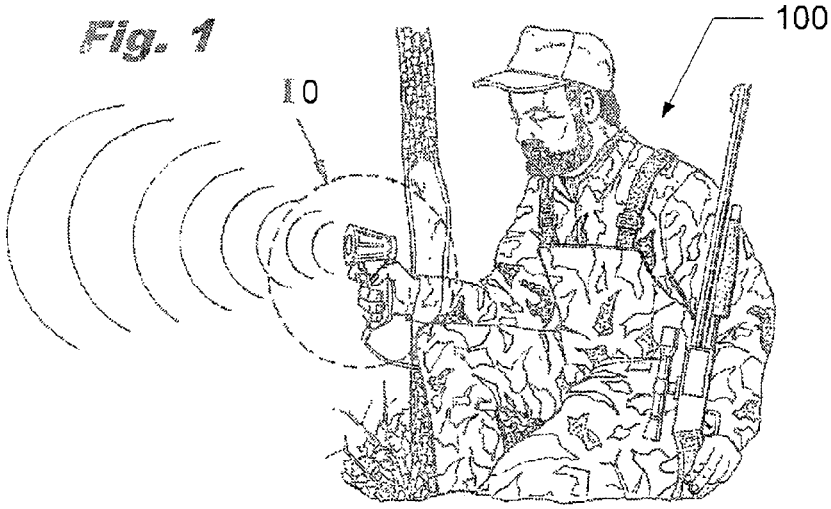
FIG. 1 illustrate a portable electrical horn configured in accordance with the present disclosure and shown in use during a sports activity.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "attached," "connect," "couple," and similar terms with their inflectional morphemes do not necessarily denote direct and immediate connections, but also include mechanical and electrical connections through mediate elements or devices.

FIG. 1 illustrates one of numerous applications of an electrical horn 10 used, for example in this instance to signal an emergency signal for a hunter lost in the forest. Alternatively, it will be recognized that horn 10 may be readily programmed to also provide a pre-recorded digital sound to, for example, imitate the sound of a wild turkey so as to attract it. As a consequence horn 10 should be recognized has having both emergency and sporting uses. During non-emergency sports activity (here hunting) a user 100 activates horn 10 generating sound signals at a frequency and pitch generally similar to those made by a wild turkey. The horn 10, however, can be used during sporting events, rescue operations and many other operations requiring generation of differing sound signals.

Figure 2:
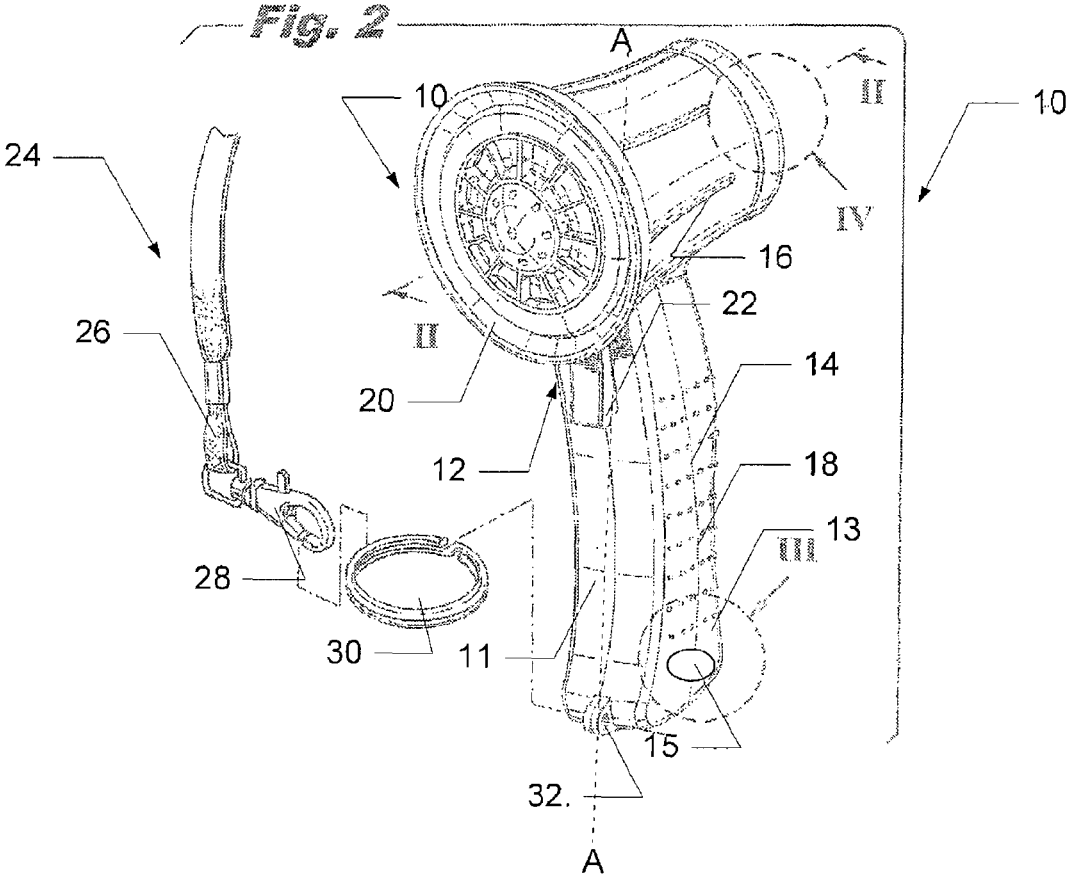
FIG. 2 is a partially disassembled view of the portable electrical horn of FIG. 1.

Referring to FIG. 2, horn 10 is configured with a housing 12 having a handle 14 and a casing 16 extending transversely to one another. The housing 12 may have numerous shapes and dimensions, which are associated with the specificity of the particular horn's application, and is not limited to a generally T-shaped cross-section illustrated in FIG. 2. Preferably, housing 12 is molded as a two-piece unit including halves 11 and 13 which are centered along a longitudinal axis A-A and are detachably coupled to one another by any known fastening means 15 including, for example, screws, bolts, and pins.

The coupling halves 11 and 13 are realized so that the entire housing is substantially water proof thereby allowing for the effective use of horn 10 even under adverse climatic conditions (moisture, dampness, ice, etc.). Each of halves 11, 13 includes respective portions of handle 14 and casing 16. However, it is conceived that housing 12 may be molded as a unitary body. Accordingly, housing 12 is made from light plastic and, due to its configuration and selection of materials, is characterized by a degree of manufacturer or customer selected robustness. A molding technique is not the only one manufacturing possibility for making housing 12 and easily can be substituted by any other suitable technique without departing from the scope of the disclosure of the present invention.

The handle 14 is ergonomically configured to provide user 100 with a comfortable grip and may have a structured surface 18 preventing undesirable motion of the user's hand and horn 10 relative to one another. Preferably, handle 14 is configured to allow the entire length of the user's hand to rest on handle 14 with the hand's finger resting on a push-button trigger 22 which is operative to activate horn 10 in response to a compressing forced applied by the user to button 22. The casing 16, as illustrated, has a generally funnel-shaped body with a distal end 20 that skirts outwards from the casing's main body. In a related design, casing 16 is alternatively configured to function s to concentrate sound in a given direction, although this is not required where a speaker member (noted later) is preferrably positioned at the open face.

In accordance with one of many salient features of horn 10, casing 16 and handle 14 are provided with respective means III and IV for receiving and storing power sources. Each of the storing means includes a compartment configured to receive and store a battery, as will be explained below. And each compartment may be optionally and selectably connected to a controlling electrical circuit, or both compartments may be jointly connected in series, and finally only one compartment may be so connected allowing the non-connect compartment to simply store a battery (power source).

The horn 10 may be conveniently suspended to the garment worn by the user. For example, a strap assembly 24 may include a flexible band having one of its ends coupled to the garment and other end 26 provided with a loop. A latch assembly has a bracket operative to reliably engage looped end 26 of the band and a latch 28 attached to the bracket. The latch 28 is operative to have an opening position, in which a safety ring 30 penetrates through the exterior of latch 28 in response to an external force applied by the user to a latch actuator, and a closed position, in which ring 30 and latch 28 are reliably engaged to one another upon ceasing the external force. The ring 30 is also operative to assume an opening position so as to be threaded though a flange 32 formed on housing 12. For example, flange 32 may be provided on the bottom of handle 14, although other locations configured for coupling ring 30 and housing 12 are conceived as well within the scope of the invention. The flange 32 has a through-going opening configured to allow the body of ring 30 to be freely suspended on flange 32 so that ring 30 may pivot and rotate relative to flange 32 in the ring's suspended position.

Figure 3:
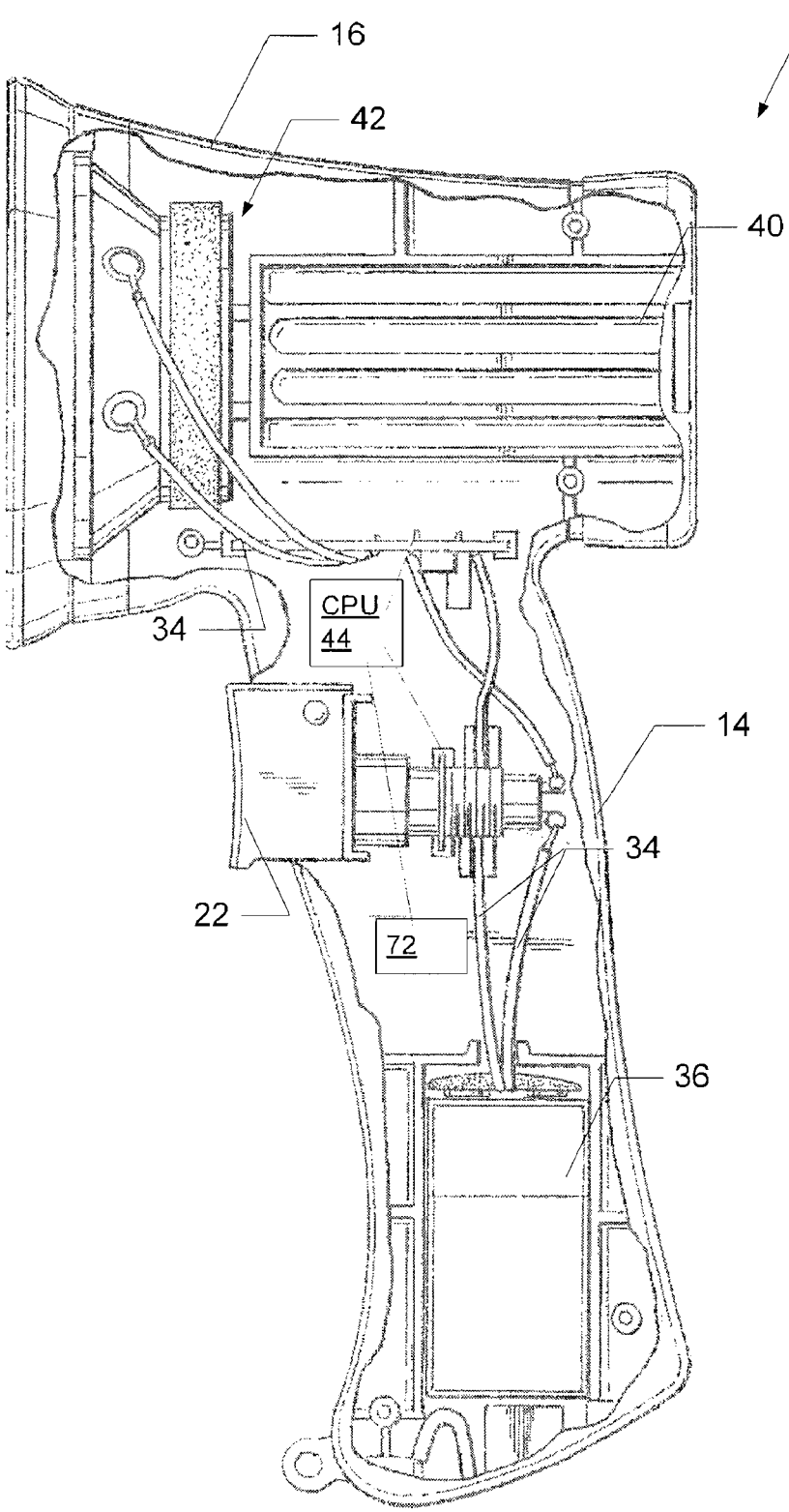
FIG. 3 an elevational cross-sectional side view of the disclosed portable electrical horn of FIGS. 1 and 2 along section line II-II.

FIG. 3 illustrates the interior of housing 10 configured to receive and store multiple power sources 36 and 40, an optional central processing unit (CPU) 44 operative to control the performance of horn 10 as disclosed below, a sound generating unit generally indicated as 42, and wires 34 coupling all of the component together. The multiple power sources 36 and 40, respectively, can be variously configured, but preferably are typical DC-9V batteries. The batteries 36 and 40 preferably are received in respective compartments III and IV formed within handle 14 and casing 16, as will be explained below. As was noted above, the present invention may be optionally configured to operate with or without central processing unit 44 depending upon manufacturer or user desire. For example, where a reduced cost and circuitry simplification are desired, a simple hard-wired (without CPU) circuit may be provided as will be recognized by those skilled in the art of consumer product electrical design. As an alternative example, where it is desired that a CPU system engage (for example) both power sources simultaneously or in series to manage sound, signal, or power output, a CPU system may be configured to achieve this goal.

The sound generating unit 42 (speaker) typically has a flexible diaphragm (usually made of spring steel or a rigidized plastic or Mylar etc.) and a coil of wire that forms an electromagnet. As well known, horn 10 functions in a manner known to those of skill in the horn arts and generally according to Hooke's Law, which states, "The extension of a spring (here the speaker diaphragm) is directly proportional to the load applied, provided the limit of proportionality is not exceeded." The flexible diaphragm, if properly designed, oscillates back and forth continuously as long as current is applied. Rapid vibration of the diaphragm displaces air, creating the acoustical output wave. Horns come in an endless variety of notes, or frequencies, and with a CPU controller 44 (containing a pre-recorded signal) may reproduce previously recorded signals, such as animal sounds, warning signals, etc. The note of a horn is determined by the flexibility of the diaphragm; its physical size; the power of the electromagnet; the mass of the diaphragm; mechanical arrangement of the switch contact; size and shape of the horn's housing and a number of other contributing factors. As readily understood by one of ordinary skills in the electrical and audio arts, the frequency may be easily adjusted to generate the desired sound. A software executable by CPU 44 is operative to change the sound in response to the user's selection, which may be realized by an indicator 72 shown diagrammatically in FIG. 3 and coupled to CPU 44. For example, the sound produced by horn 10 may be chosen from the sound of animals selected from the group including, but not limited to, a hen, bull, horse, sheep, rooster, frog, dog, duck, cat, wild turkey. Similarly, a software executable by CPU 44 may regulate the duration and rate of the generated sound.

Figure 4:
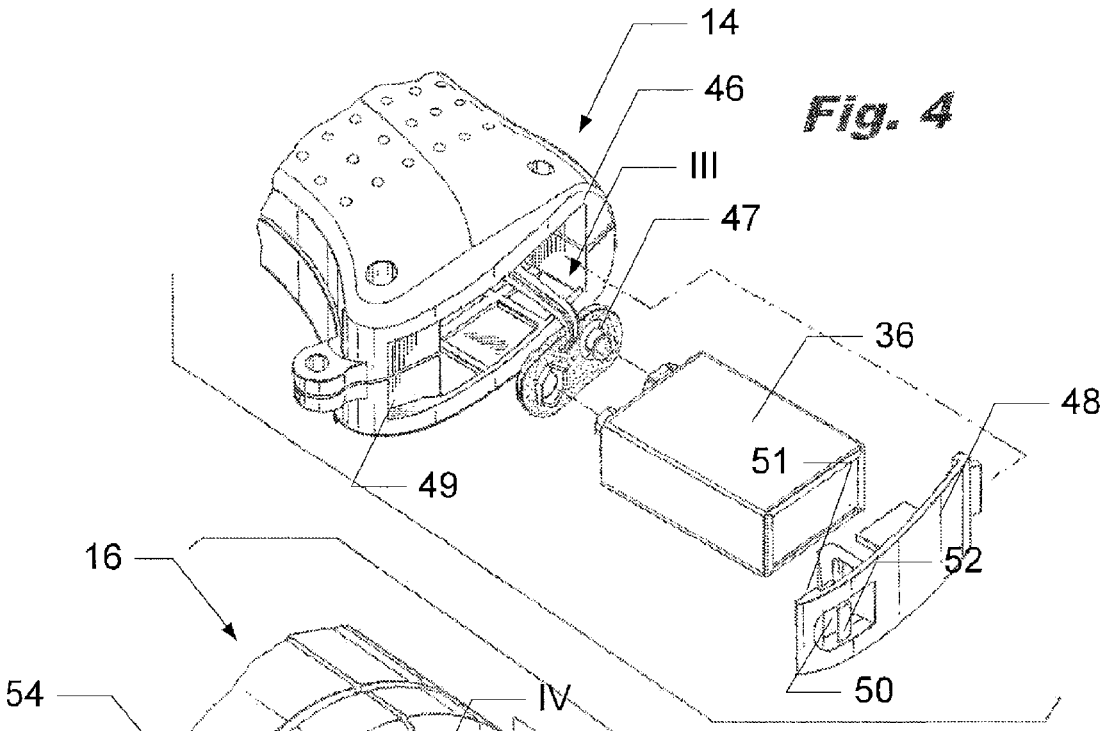
FIG. 4 is an elevational view a battery receiving compartment provided in a lower casing of the disclosed horn at region III in FIG. 2.

Referring to FIG. 4, a bottom 46 of handle 14 has compartment III configured to receive battery 36 that can be slid into compartment III to a mounting position in which a gasket 47 reliably engages the poles of the battery. To reliably secure battery 36 in the mounting position, a shutter 48 is configured to releasably close the opening of compartment III and retain the battery within the compartment. Upon manually inserting battery 36, shutter 48 is juxtaposed with the opening of compartment III and then pushed thereinto so that, when shutter 48 reaches its closed position, the outer surface of the shutter lies flush with the outer surface of handle's bottom 46. The body of shutter 48 has a window 50 provided with a biased locking unit 52 which is configured with a bent distal or inner end resiliently urging against the inner side surface of compartment III. As a consequence, shutter 48 is frictionally engaged with handle 14 and can be disengaged upon applying an external pulling force sufficient to overcome a friction force generated by the distal end of locking unit 52 for displacement of shutter 48 from compartment III. To prevent uncontrollable displacement of shutter 48 into compartment II, the latter has a stop surface 49 abutting and extending complementary to a surface 51 of shutter 48 in the shutter's closing position. Preferably, but not necessarily, battery 36 mounted to handle 14 is a primary power source.

Figure 5:
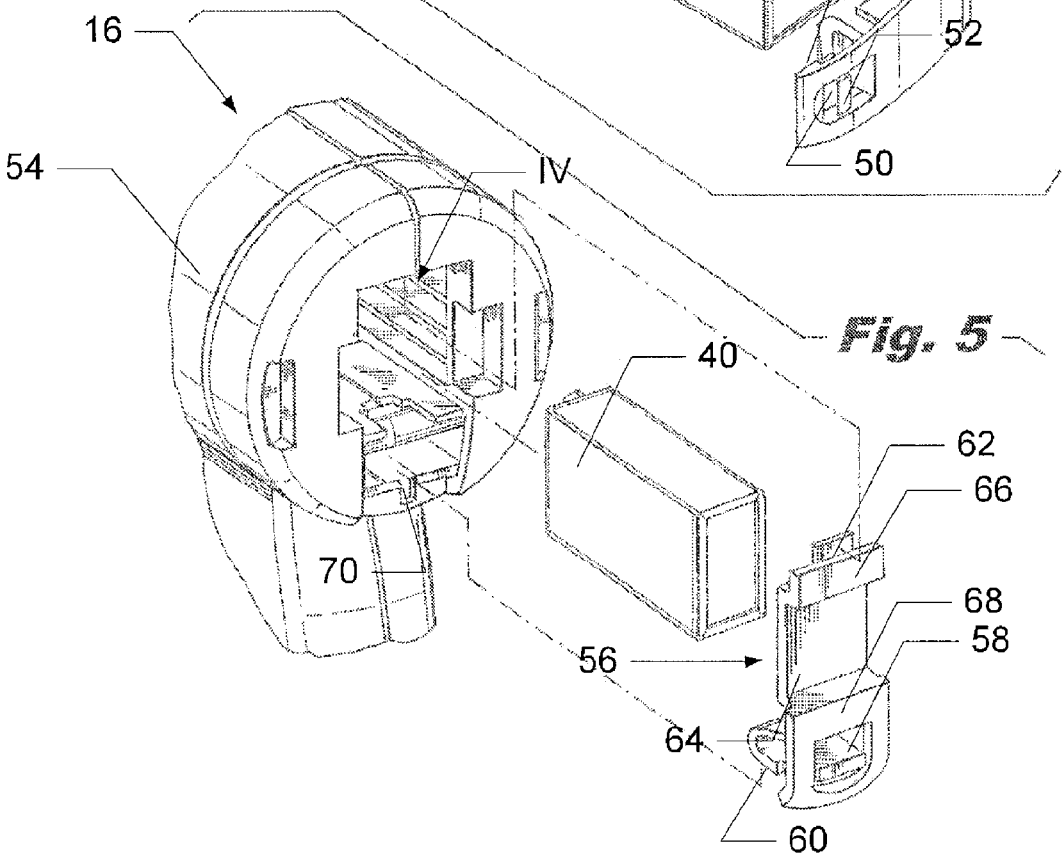
FIG. 5 is an elevational view a battery receiving compartment provided in an upper head region of the disclosed horn at region IV in FIG. 2.

Turning to FIG. 5, compartment IV is provided in a proximal end 54 of casing 16 and configured to receive spare battery 40. The opening of compartment IV cuts into one of the opposite edges of casing 16 and terminates at a distance from the other end. When battery 40 is slid into compartment IV to its desired mounting position, a shutter 56 closes the opening and secures the batter in the desired position. The shutter 56 has a generally U-shaped cross-section including a central bottom portion 64 which is provided with the inner surface which abuts the opposing surface of battery 40 in the closing position of the shutter. Two angled flanks 66 and 68 bound central portion 64 and have respective coplanar inner surfaces offset from the inner surface of central portion 64 so that when shutter 56 closes the opening of compartment IV, the outer surfaces of flanks 66 and 68 lie flush with the surrounding outer surface of casing 16 while central portion 56 is sunk. The desired closing position of shutter 56 is further ensured by a guide channel 70 recessed in the floor of compartment IV and configured to slidably receive a fin (not shown for the purposes of clarity, but well understood by one of ordinary skills in the mechanical arts) which is provided on the inner surface of flank 68 and extends beyond flank 68. During installation of shutter 56, it is initially slightly slanted to have an arm 62, which is provided on the inner surface of flange 66, to abut the floor of the compartment. Then shutter 56 is brought substantially parallel to the longitudinal axis of the opening of compartment IV so as to have the fin received in channel 70. Further, shutter 56 is pushed inwards to assume the desired closing position. To secure shutter 56 in the desired closing position, it has a locking unit 58 configured similarly to locking unit 50 of shutter 48 (FIG. 4). Accordingly, an inner end 60 of locking unit 58 is resiliently biased against the opposing surface of compartment IV in the desired closing position of shutter 56. To open shutter 56, an external force may be applied to locking unit 58 so as to pull it with a force sufficient to overcome a biasing force of inner end 60 of locking unit 58 directed against the inner surface of casing 16.

In one optional example of actual operation, the user presses switch 22 (FIG. 3), which can be configured as a pushbutton or toggle switch, and at that moment the electrical contact allows current flow to a relay, which in turn furnishes current to the horn's electromagnet attracting a diaphragm of sound-generating unit 42. As a consequence, the diaphragm flexes to its mechanical limit and disengages the contact, which stops current flow to the electromagnet. The diaphragm is released to travel back past neutral position closing the switch again, and thereby pulling the diaphragm back, setting up an even oscillation.

Figure 6:
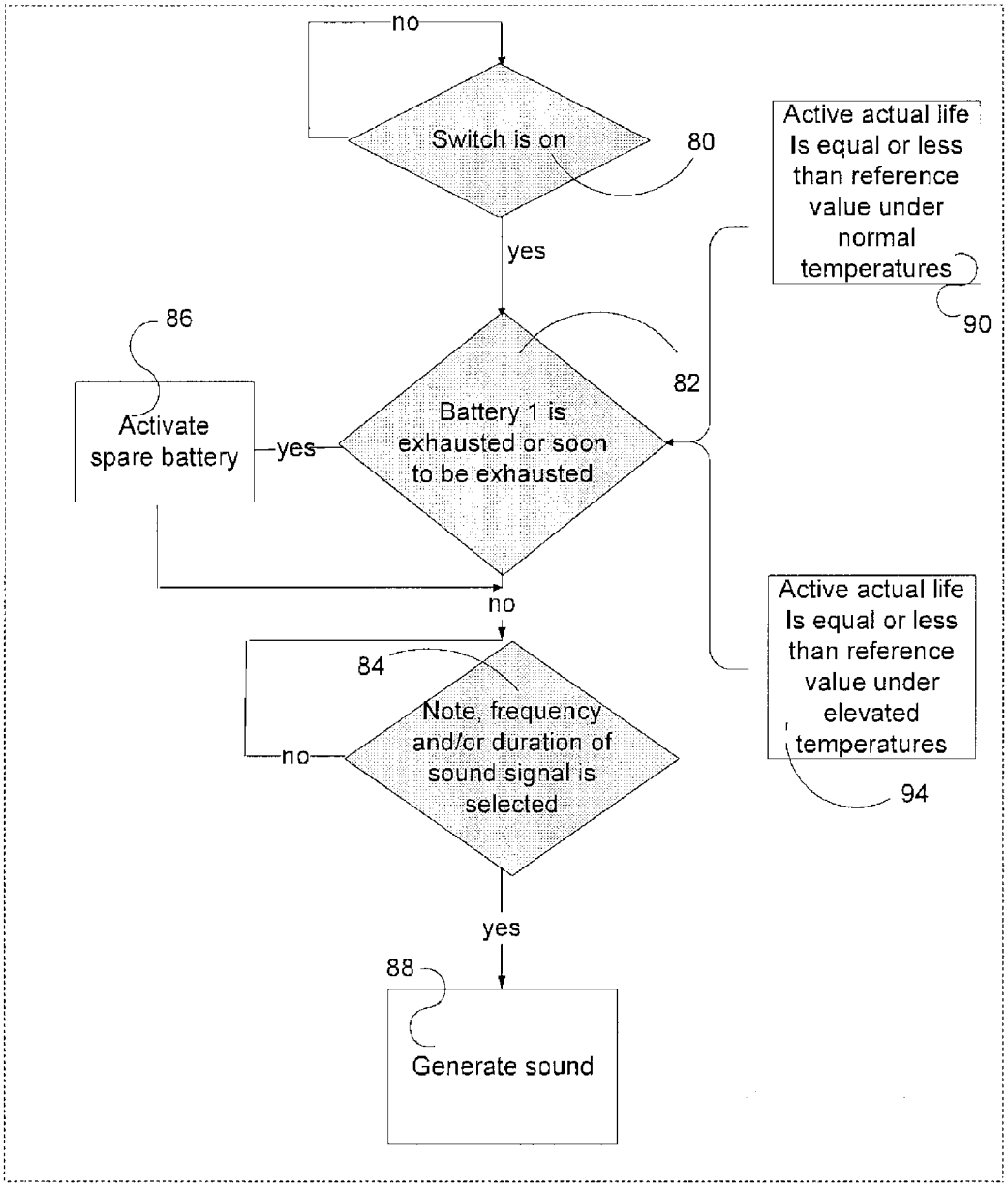
FIG. 6 is a block diagram illustrating an optional operational sequence of one embodiment of the disclosed horn.

Referring to FIG. 6 in addition to FIG. 3, in response to activating switch 22 (FIG. 3) during a step 80, a software executable by optionally-included CPU 22 may determine the power/life status of a currently working battery, for example, battery 36 (FIG. 4) as illustrated by a step 82. Among a variety of monitoring techniques, CPU 44 may, for example, include a software for tracking and storing the actual life of the battery, i.e., the time during which the battery has been actually powering horn 10. If the stored reference value has been reached, a software executable by CPU 44 may automatically switch battery 36 to battery 40 (FIG. 5). One of ordinary skills in the electrical arts will readily realize a simple battery-switching circuit actuated by CPU 44 in response to a signal indicating that the resources of battery 36 have been already depleted or soon to be depleted. Having determined that battery 36 is to be replaced, a software executable by CPU 44 actuates spare battery 40 as illustrated by a step 86.

The horn 10 may be operated under different climatic conditions. One of the important climatic conditions that may critically affect the active life of the battery is temperatures. If horn 10 is used at normal temperatures, as indicated by a step 90, batteries 36 and 40 would typically operate longer than under the elevated temperatures. The CPU 44 may, for example, execute a software which is operative not only track the actual working hours of the battery, but also an ambient temperature. If the battery operates under adverse climatic condition as indicated by a step 94, the software may adjust the expected actual life of the battery and rather shorten it, if the temperatures have been detected to be higher than a certain reference value for a predetermined period of time.

Having ensured that horn 10 is properly powered, a software executed by CPU 44 further may adjust a note, frequency and/or duration of a sound signal in response to the user's selection, as illustrated by a step 84. Finally, when horn 10 is ready to operate, software executed by CPU 44 actuates sound generating unit 42 to produce the desired sound.

One of ordinary skills in the electrical arts of course will readily understand that the actual life of batteries can be monitored in a variety of ways. Furthermore, the user may always either switch the batteries manually by operating a manual switch. Alternatively, only one compartment III and IV (FIG. 2) may be configured to provide electrical connection between the battery and the rest of the horn's components. In this case, the user would have to manually replace a dead battery but would be reassured that the un-used/stored battery would include remaining power for emergency use. Although horn 10 is preferably made from plastic, other materials, such as metal, can be successfully utilized.

It shall be additionally recognized that power source 36 may be optionally employed as a re-chargeable power source that is either removably retained in body 14 or may be fixably engaged therewith out departing from the scope and spirit of the present invention. Where a manufacturer employs the option of incorporating a rechargeable battery/power source, it shall be recognized that horn 10 may be equipped with a recharging mechanism of those types known to those of skill in the art of rechargeable consumer electronics.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

The specific features described herein may be used in some embodiments, but not in others, without departure from the spirit and scope of the invention as set forth. Many additional modifications are intended in the foregoing disclosure, and it will be appreciated by those of ordinary skill in the art of electrical consumer product design that in some instances some features of the invention will be employed in the absence of a corresponding use of other features. The illustrative examples therefore do not define or limit the metes and bounds of the invention and the legal protection is afforded by the appended claims.

The invention claimed is:

1. A horn comprising:

a body;

a sound generating unit in said body;

at least two electrical power source storage regions in said body;

an electrical control circuit mounted in said body and operably enabling electrical current flow from at least one external power source stored within at least one of said at least two electrical power source storage regions to said sound generating unit upon an actuation thereof; and said electrical control circuit executing software operative to selectively couple between said sound generating unit and said at least two electrical power source storage regions, wherein upon receiving said at least one external power source in one of said electrical power source storage regions said software selectively designates a coupling to said power source to provide a continuous power supply to the sound generating unit during said actuation.

2. The horn of claim 1, wherein:

said body has a substantially T-shaped cross-section and is provided with two spaced apart interior compartments as respective storage regions each configured to releasably receive a respective one of the external powers sources.

3. The horn of claim 2, further comparing:

a switch operable by a user and operatively engagable with said electrical control circuit and said software and displaceably mounted to said body to enable said actuation thereof and displaceable between an operative on- and off-position.

4. The horn of claim 3, further comprising:

first and second shutters removably mountable to said body so as to close respective electrical power source storage regions in said body and secure said respective power sources therein.

5. The horn of claim 4, further comprising:

a suspension unit operative to couple said body to an external user controlled item, said suspension unit being detachably engagable with at least one of said body and said user controlled item thereby enabling a secure attachment and detachment of said horn upon a user desire.

* * * * *